US007134576B2

(12) United States Patent
Gringer et al.

(10) Patent No.: US 7,134,576 B2
(45) Date of Patent: Nov. 14, 2006

(54) MULTIFUNCTION POURING SPOUT AND REMOVABLE LID

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 0 days.

(21) Appl. No.: 10/830,275

(22) Filed: Apr. 22, 2004

(65) Prior Publication Data

US 2005/0236443 A1 Oct. 27, 2005

(51) Int. Cl.
*B67B 5/00* (2006.01)
*B65D 25/48* (2006.01)

(52) U.S. Cl. ..... 222/143; 222/153.07; 222/153.14; 222/570; 222/571; 220/701

(58) Field of Classification Search ..... 222/143, 222/153.07, 153.09, 153.14, 567, 570, 571; 220/230, 695, 699, 701
See application file for complete search history.

(56) References Cited

U.S. PATENT DOCUMENTS 2,731,178 A * 1/1956 Larsson ..... 222/567
3,913,785 A * 10/1975 Pattershall ..... 220/733
4,911,319 A * 3/1990 DeJean ..... 222/570
5,269,438 A * 12/1993 Kelsey ..... 220/766
5,893,489 A * 4/1999 Giarrante ..... 222/482
6,135,310 A * 10/2000 Svehaug ..... 220/700
6,213,338 B1 * 4/2001 Cogdill ..... 220/700
6,896,156 B1 * 5/2005 McDonald et al. ..... 222/109
2004/0065698 A1 * 4/2004 Braunstein et al. ..... 222/570

* cited by examiner

*Primary Examiner*—Joseph A. Kaufman
(74) *Attorney, Agent, or Firm*—Gottlieb, Rackman & Reisman, P.C.

(57) ABSTRACT

An inventive pouring spout for containers of liquid, having a removable lid and a strip with magnets located thereon. The spout is selectively attachable and is fitted to the diameter of an opening of a particular container. In a preferred embodiment, the spout is fitted to the diameter of a paint can opening, where it may replace the typical lid of a paint can for the duration of its use. Essentially, the spout effectively prevents the entry of paint in the sealing groove of the paint can or on the sides of the can.

57 Claims, 7 Drawing Sheets

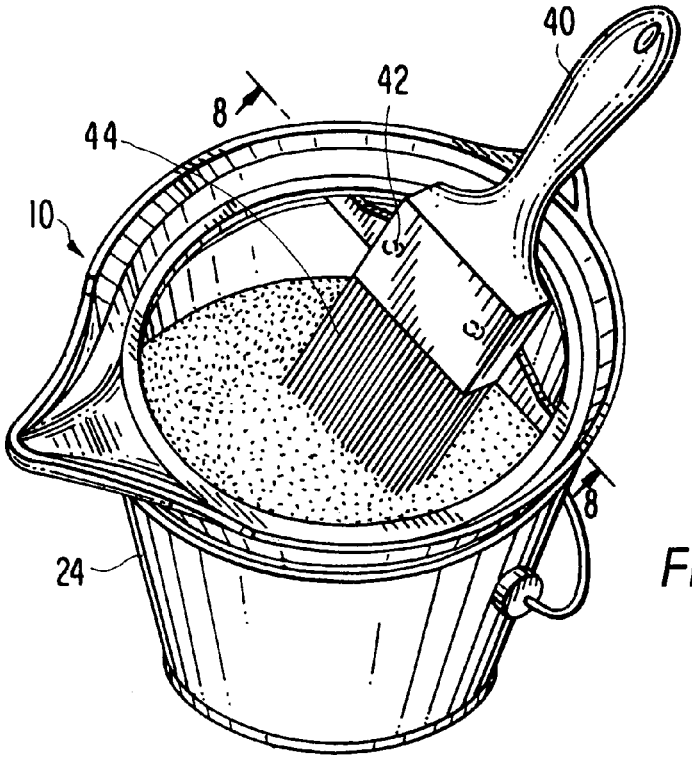
FIG. 7
FIG. 8
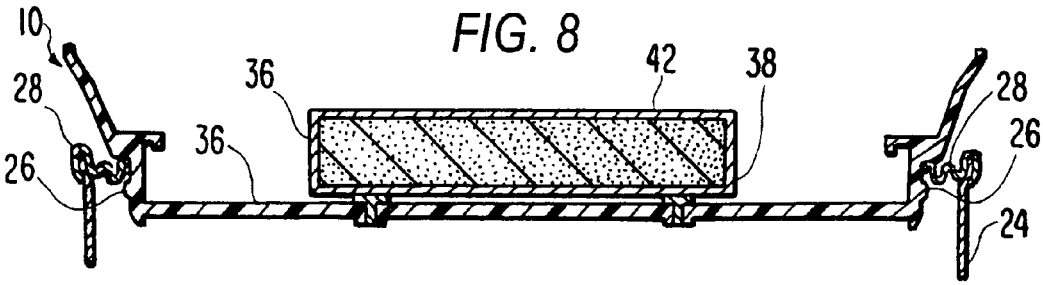

MULTIFUNCTION POURING SPOUT AND REMOVABLE LID

FIELD OF INVENTION

This invention relates to a multifunction cover for containers, such as paint cans. More specifically, this invention involves a detachable pouring spout having a removable lid which prevents the dripping and splashing of paint along the side and around the opening of a paint can.

BACKGROUND OF THE INVENTION

For both the professional and casual painter, typical paint cans feature a multitude of drawbacks. Most notably, the construction of a typical one-gallon size paint can makes it virtually impossible to pour paint out of the can into a paint tray or other container without paint trickling down the sides of the can after the paint is poured. Excess paint dripping down the exterior of the can may cause undesirable paint smears on walls, floors, furniture and other items when the dripping paint accidentally comes in contact with one or more of these surfaces or objects. Further, the problem of paint running down the side of the can is aggravated when a user rests a wet paintbrush horizontally across the top of the paint can, as many painters typically do overnight or during a break. Paint from a wet paintbrush drips down the side of the can, causing similar problems noted above.

Further, there are a number of other common occurrences that often irritate painters and present additional difficulties. For instance, after paint is poured out of the can, a certain quantity always remains at the opening of the can in its sealing groove. The paint in this sealing groove poses the following problems: first, if the metal paint can lid is placed onto the can top and into the groove before the paint in it dries, the paint acts as an adhesive, sealing the lid to the can and making it more difficult to remove later on. In addition, when the cover is subsequently re-installed, paint in the sealing groove spatters as the lid is tapped down, causing paint to be dispersed randomly on the painter or on a surface.

Similarly, these problems are also encountered when dipping a paintbrush in a paint can and then wiping the brush against the inner rim of the can to remove excess paint from the brush. Although painters are aware of this problem, they choose to wipe the brush against the inner rim since the alternative (i.e., spreading the excess paint over a given area) may ruin the job at hand, thereby entirely undermining their efforts.

Moreover, although it is good practice to replace the paint lid on the can overnight or during a lunch break to keep the paint fresh, many fail to do so and introduce paint to the side of the can lid and in its sealing groove.

SUMMARY OF THE INVENTION

Accordingly, it is an object of the present invention to provide a detachable pouring spout for a paint can, which includes a removable lid, that prevents the entry of paint into the sealing groove at the opening of the can and prevents the dripping of paint along the exterior surface of the paint can.

Another object of the present invention is to provide a detachable pouring spout for a paint can, which includes a removable lid, that enables the removal of excess paint from a paint brush directly into the paint can without utilizing the interior rim of the can.

A further object of the present invention is to provide a means for storing a wet paint brush above a paint can that allows paint to be reintroduced to the interior of the paint can and prevents the paint from contacting the sealing groove of a paint can or its exterior surface.

Another object of the present invention is to provide a detachable pouring spout for a paint can, which includes a removable lid, that eliminates the need to re-install the original paint can lid between uses.

A still further object of the present invention is to provide detachable pouring spout for a paint can, which includes a removable lid, that enables multiple paint cans to be neatly stacked on one another, even when the pouring spout is engaged to the top of the paint can.

Additional objectives will be apparent from the description of the invention that follows.

In its broadest aspects, the invention involves a pouring spout for containers of liquid, which has a removable lid or insert. The inventive pouring spout is preferably selectively attachable and detachable with respect to the container, and is fitted to the diameter of an opening of a particular container. In a preferred embodiment, the spout is fitted to the diameter of a paint can opening, where it may replace the typical lid of a paint can for the duration of its use.

The invention comprises a spout with a central opening that is selectively covered with a removable lid whether overnight, during a break or at any time when the paint from the can is not immediately needed. The spout includes a groove or a ridge at or near the base or lower edge of the spout which enables the spout to snap into the primary opening of the paint can. The spout fits snugly into the paint can, thereby preventing paint from being introduced to or within the sealing groove of the can. By utilizing the spout, paint from the can may instead accumulate on the spout, thereby relieving the problem of paint being accumulating at the sealing groove of the can and along the sides of the can. Further, the removable lid includes a receiving groove that does not collect paint, which enables the lid to snap into the central opening of the spout. This forms a tight seal over the paint can keeping the paint fresh and ready for use when needed.

In a preferred embodiment, the spout further comprises a bridging strip having an edge that allows a user to remove excess paint from the brush against the edge, thus simultaneously reintroducing the excess paint into the can. This strip allows a user to avoid wiping excess paint on the interior rim of the paint can, thereby further preventing paint from accumulating on the sealing groove.

Significantly, this same strip may also contain one or more magnets incorporated therein, so that after a wet paintbrush is used, the magnets attach to the metallic ferrule of the brush. Thus, the magnets hold the brush upright in place, allowing paint from the brush to drip back into the can, minimizing waste and maintaining cleanliness.

The pouring spout may be constructed of materials, including plastics and metals, which are well known in the art. Preferably, the pouring spout is injection molded from polypropylene and the removable lid is preferably constructed from polyethylene.

BRIEF DESCRIPTION OF THE DRAWINGS

FIG. 7 is a perspective view of a preferred embodiment of the pouring spout connected to a paint can and the ferrule of a paintbrush attached to two magnets located on the strip;

FIG. 8 is partial cross sectional view of the ferrule of a paintbrush attached to two magnets located on the strip taken along line 8—8 of FIG. 7;

DETAILED DESCRIPTION OF THE INVENTION

Figure 1:
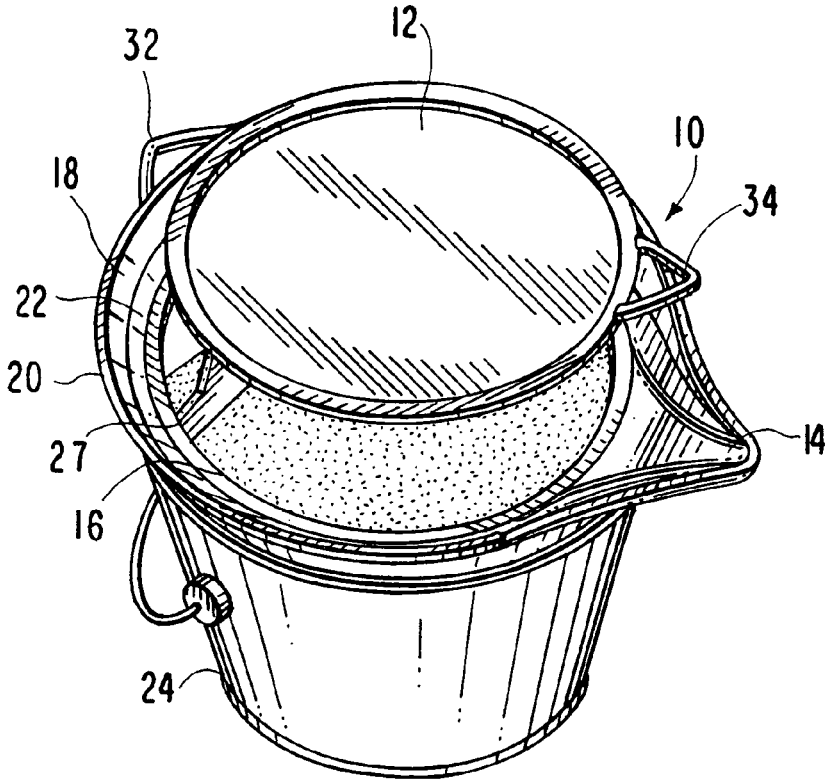
FIG. 1 is a perspective view of a preferred embodiment of the inventive pouring spout with removable lid connected to a paint can at its opening, the lid being slightly removed from the spout for ease of view.

Referring to the drawings, FIG. 1 depicts a preferred embodiment of the inventive pouring spout (10) having a removable insert or lid (12). Each spout (10) also has a mouth (14), a central circular opening (16) and a lateral surface which forms a wall (18) having an upper edge or rim (20) and a lower edge or rim (22). Preferably, the lateral surface proceeds at an angle greater than ninety degrees from horizontal, such that the wall (18) that is formed inclines outwardly and upwardly from the center and lower edge (22) of the spout (10). Of course, the lateral surface may run at an angle that is ninety degrees or less from a horizontal surface of a container as well. In addition to forming the wall (18) of the spout (10), the lateral surface also forms a mouth (14). The mouth (14) extends outwardly beyond the perimeter of the wall (18) forming a channel out of which liquid is poured from its container. As the channel extends away from the center of the spout (10), it gradually narrows, forming a triangular shape, thereby allowing the liquid to converge and be poured neatly from the spout (10). In the embodiment shown in FIG. 1, the spout (10) is fitted to the diameter of an opening of a paint (or other fluid) can (24) and is selectively attachable and detachable to it. Obviously, the pouring spout (10) can be fitted to openings having many other geometric shapes, including squares, rectangles and ovals. Further, the spout (10) and the container for which it is used may together form one solid unitary structure.

In a preferred embodiment shown in FIG. 1, the lower rim (22) of the pouring spout (10) fits the opening of the paint can (24) much like the standard metal lid used to cover the paint can (24) when it is sold at hardware stores. Accordingly, the spout (10) can be easily inserted into the opening of the paint can (24) once the metal lid is removed. Near the base of the spout (10), just above the lower rim (22), there is a channel or groove (26) around the perimeter of the spout (10) on the outside of the wall (18). The groove (26) enables the spout (10) to snap into place at the opening of the can (24) just as the lower rim (22) is inserted into the paint can (24). When the pouring spout (10) snaps into place, a seal is formed between the spout (10) and the sealing groove (28) of the paint can (24) (as shown in detail in FIG. 4), thereby preventing paint from coming into contact with the sealing groove (28). Other configurations may be provided to detachably engage the spout to a paint can.

Figure 2:
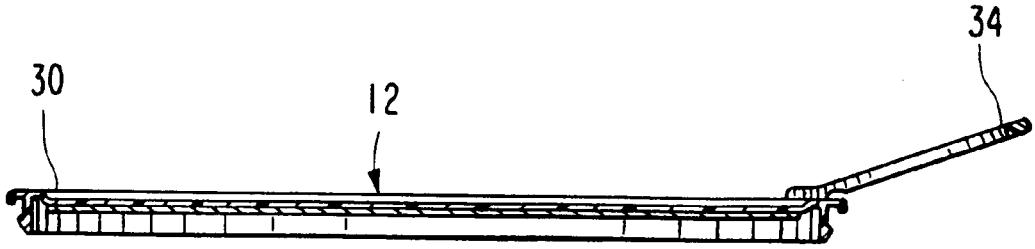
FIG. 2 is a side elevational view of the removable lid.
Figure 2A:
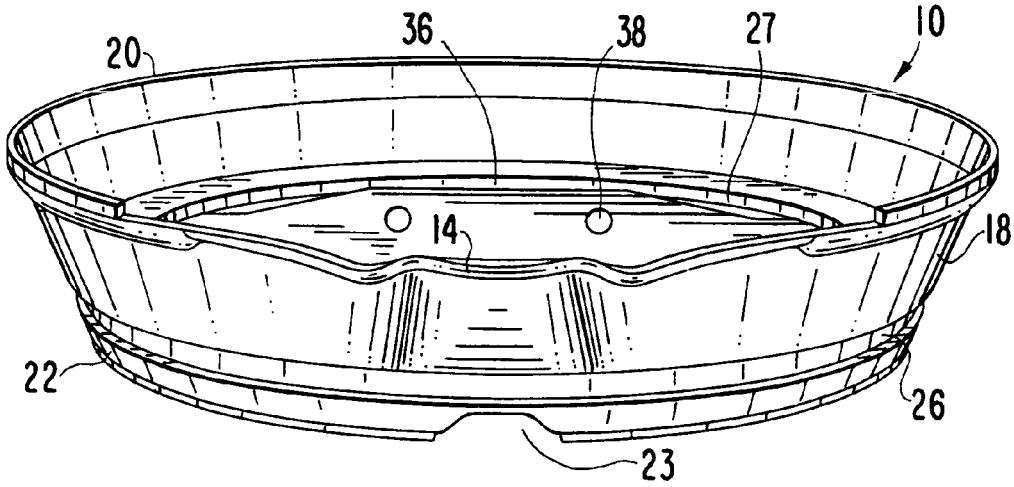
FIG. 2A is a front elevational view of the pouring spout without the removable lid.
Figure 2B:
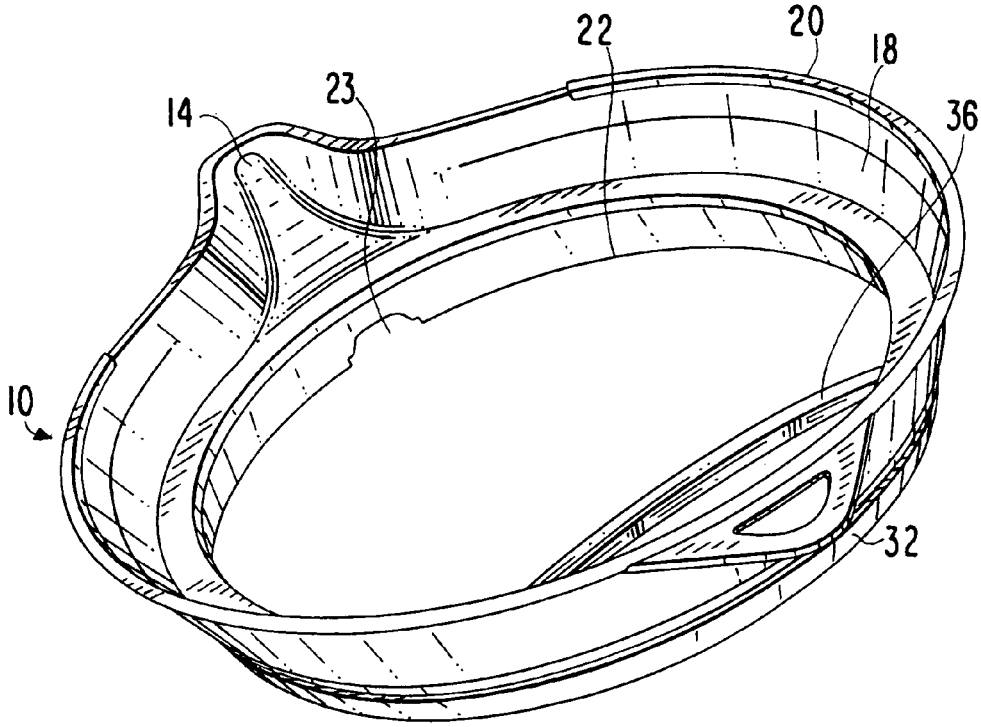
FIG. 2B is a top elevational view of the pouring spout without the removable lid.

Further, as shown in FIGS. 2A and 2B, the lower rim (22) of the pouring spout (10) incorporates a cutout (23) in the front of the spout (10), which allows the paint to flow relatively free from obstruction, thus permitting the flow of paint out the can when only minimal amounts of paint remain in the can.

The wall (18) of the spout (10) surrounds its interior and runs parallel to the circumference of the paint can (24). In case the can (24) is tilted at an extreme angle, the wall (18) prevents paint from spilling over the upper edge (20) of the spout (10) before it can exit out the mouth (14). Of course, other types of walls may be constructed, including walls of varying heights, walls that do not fully surround the interior of the spout (10) or walls which are not parallel to the circumference of the paint can (24). In addition the spout can also be constructed with more than one mouth or passageways out which paint or other liquids may flow. Moreover, a mouth or passageway may also be formed as gap in the wall or from a separate member attached to the wall as a means to assist the flow of paint or other liquid, rather than exclusively a structure that is created as an extension of the wall.

FIG. 1 shows a perspective view and FIG. 2 shows a side view of the removable lid (12) of the pouring spout (10). Generally, the lid (12) is sized to fit the central opening (16) of the pouring spout (10). Significantly, the lid (12) includes a groove or a lip (30) that continues around the perimeter of the lid (12), enabling it to snap into the central opening (16) of the spout (10). The spout (10) therefore preferably includes a protrusion (27) or other corresponding structure to accept the lid (12) and to maintain a tight fit. Obviously, other conventional locking means may be used to attach the lid (12) to the spout (10). After the spout (10) is engaged to the can (24), the lid (12) may close over the paint can (24), forming a seal and keeping the paint fresh for as long as it is not needed. Since the lid (12) is selectively removable, when paint is needed, the lid (12) is removed with little effort.

In a preferred embodiment, the spout (10) also incorporates one or more hangup loops (32), which preferably forms a triangular shape, by which a user can jerk the spout (10) out of the paint can (24) after the paint is exhausted or when the spout (10) is no longer needed. The removable lid (12) may also incorporate one or more hangup loops (34), also of a desirable triangular shape, by which a user can easily remove the lid (12) when the paint is ready to be poured from its can (24). When either the spout (10) or removable lid (12) is not in use, each may also hang by their respective hangup loops (32,34) on a hook or nail hammered into a wall. Obviously, each hangup loops (32,34) may be replaced by a tab (not shown) without an opening, by which a user may still pull the spout (10) from the paint can (24), or lid (12) from the spout (10).

Figure 3:
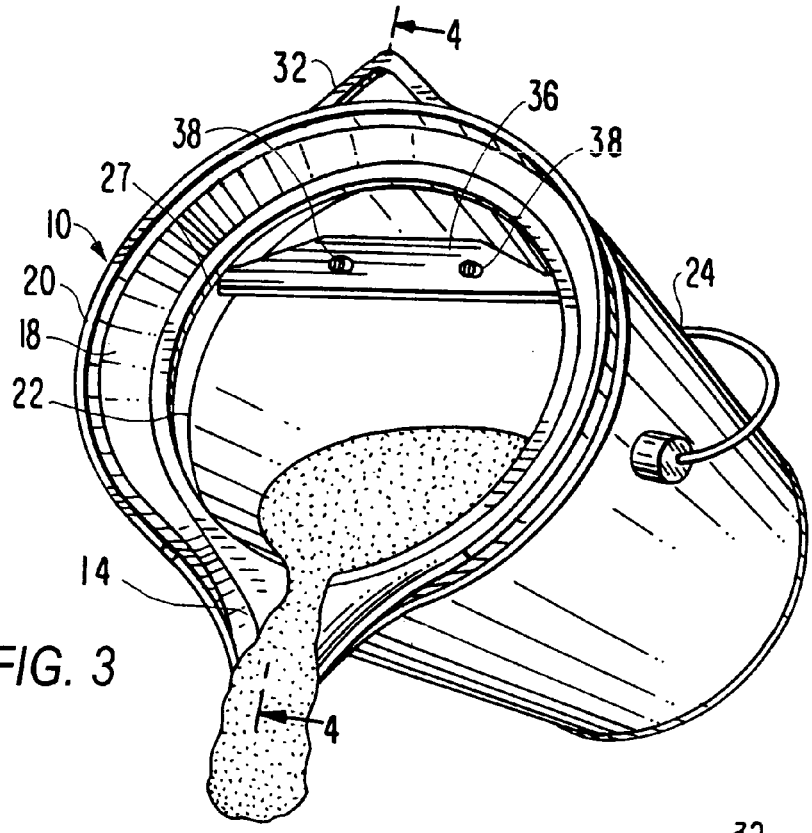
FIG. 3 illustrates paint being poured out of a paint can having a preferred embodiment of the inventive pouring spout connected thereto.
Figure 4:
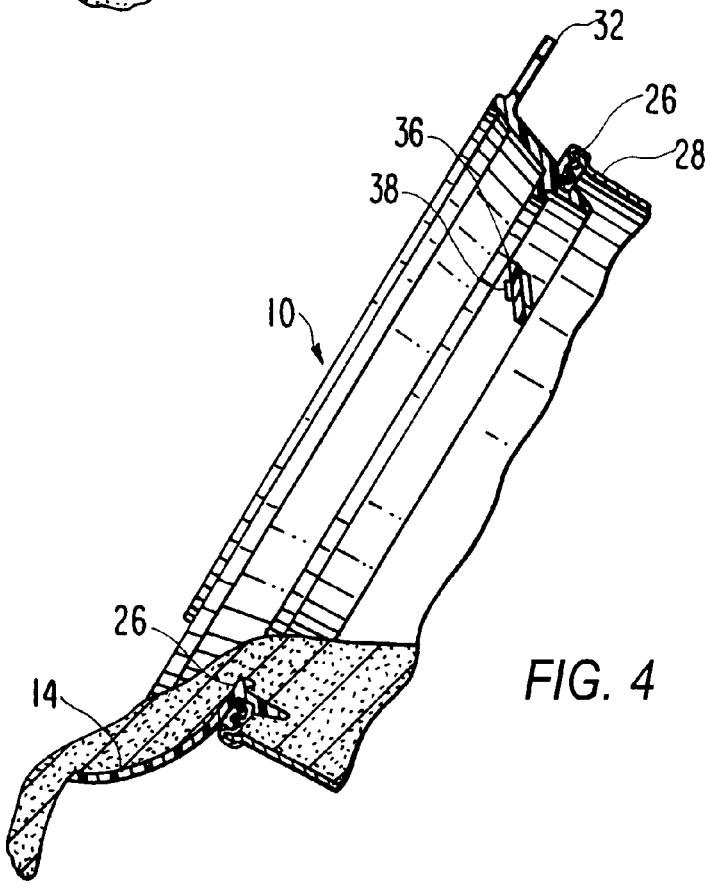
FIG. 4 is partial cross sectional view of a preferred embodiment of the pouring spout connected to a paint can and paint pouring therefrom taken along line 4—4 of FIG. 3.

FIGS. 3 and 4 show paint being poured out of a can (24) that has a preferred embodiment of the pouring spout (10) attached thereto. As shown in more detail in FIG. 4, when the can (10) is tilted, paint enters the spout (10) at its lower edge (22) and continues through to the mouth (14) from where it is poured into another container (not shown). Importantly, the groove (26) of the spout (10), whose dimensions correspond to the sealing groove (28) of the paint can (24), allow paint from the can (24) to accumulate on the groove mouth of the spout (10) rather than the sealing groove (28) of the paint can (24).

Figure 5:
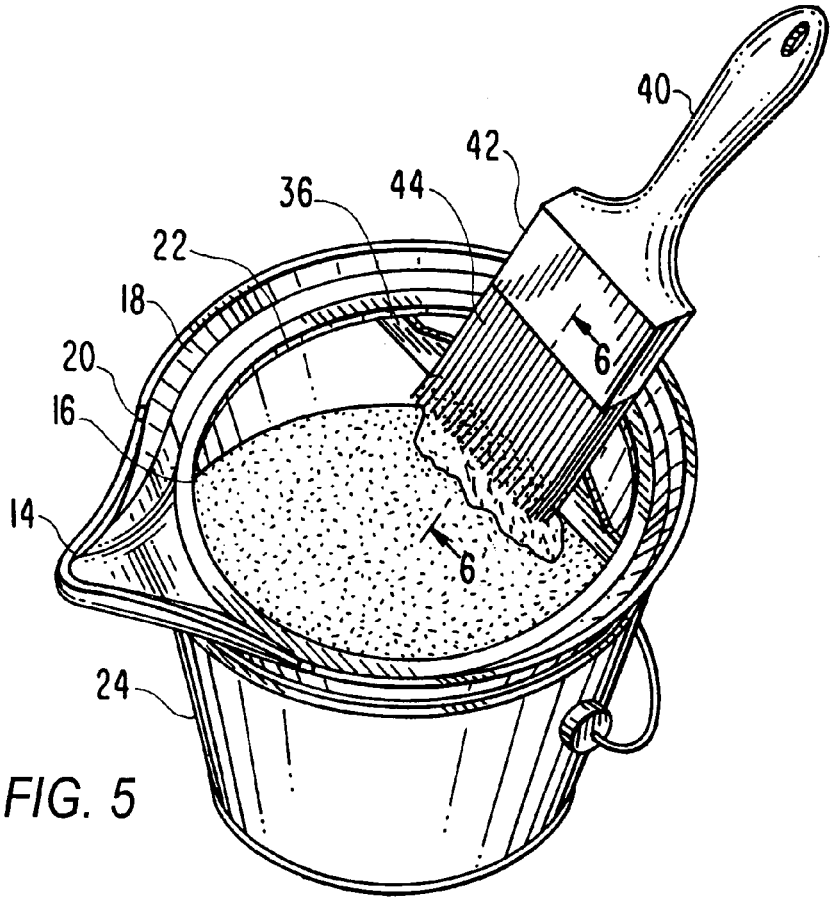
FIG. 5 is a perspective view of a preferred embodiment of the pouring spout connected to a paint can and a paintbrush being drawn against a strip, reintroducing excess paint into the paint can.
Figure 6:
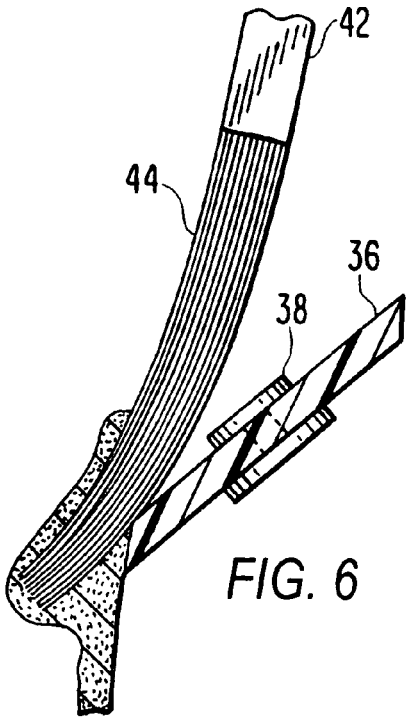
FIG. 6 is a partial cross sectional view of a paintbrush being drawn against a strip, thereby removing excess paint from the brush taken along line 6—6 of FIG. 5.

FIGS. 5 and 6 show a paintbrush (40) being drawn against a bridging strip (36) having a lower edge (37) that removes excess paint from the bristles (44) of the brush (40) as it is drawn. Essentially, the strip (36) approximates the function of a squeegee, coming in contact with the paintbrush (40) along a generally straight surface formed by its ferrule (42) and encased bristles (44). After the paintbrush (40) is dipped in paint, it is forced against the strip (36), thereby pushing some paint out of the brush (40), so that there is no excess paint on the brush. Of course, the strip (36) can also be used to force excess liquids or paint from other brush-type devices having a bristles attached thereto. In a preferred embodiment, the strip (36) is generally flat and thin and approximately one-half inch to one inch in width. The strip (36) also contains an angled edge (37) that helps remove excess paint. Further, the length of the strip (36) is generally dependent on the diameter of the central opening (16) and may be of a length corresponding to any line drawn from one point of the wall (18) to another. Moreover, in a preferred embodiment, the strip (36) is placed near the wall of the spout (10) (not in the center) and opposite the mouth (14) to help prevent paint from unnecessarily coming into contact with the strip (36) when the paint is poured. In addition, the strip (36) is also preferably located beneath the removable lid (12), since it has little use when the paint can (24) is covered to keep excess paint within the can and not on the lid.

Figure 6A:
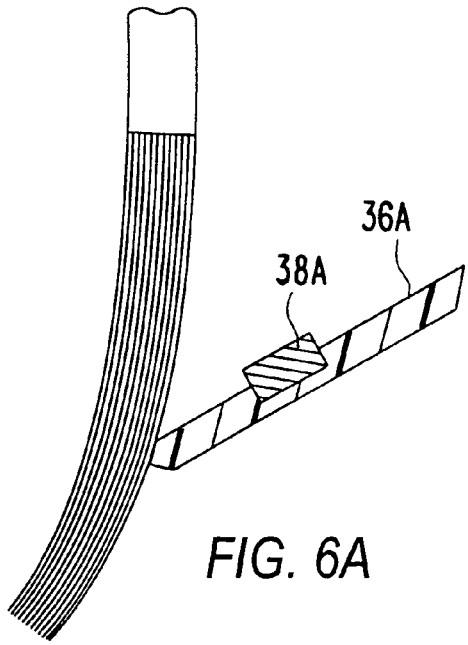
FIG. 6A is a partial cross sectional view of a paintbrush being drawn against another embodiment of a strip.

As depicted in FIG. 6A, another embodiment of the strip (36A) incorporates a double-angled edge (37A), wherein the top surface and bottom surface of the strip (36A) (37A) angle toward one another, forming the shape of an arrowhead.

Of course, other embodiments of the pouring spout may include, in place of the bridging strip, a surface that protrudes inwardly from the wall of the spout in place of the bridging strip (36, 36A). Such a surface can be constructed as an integral portion of the spout or can be a separate component that is attached to the spout by forming an interlocking groove on the surface and/or wall whereby the surface snaps into place on the wall or by using other conventional means including hooks, male-female snaps etc. In these other embodiments, the surface would also preferably include a straight edge. Further, the surface would also preferably be located beneath the removable cover or insert.

FIGS. 7 and 8 illustrate a preferred embodiment of the pouring spout (10) having one or more magnets (38), desirably two magnets, attached to the strip (36). Importantly, the magnets (38) are attached to the top of the strip (36) such that at least one surface of each magnet (38) is exposed. By exerting its magnetic attraction to the metallic ferrule (42), the magnets (38) suspend a paintbrush (40) over the opening of the paint can (24), allowing paint from the brush (40) to drip into the interior of the can (24).

The magnets (38) are attached to the strip (36) by conventional means well known in the art. Obviously, one larger magnet may be used in place of two or more magnets. As shown in FIG. 6A, the magnets (38A) may also be embedded in the strip (36A), leaving the upper surface of the magnets (38A) exposed.

Furthermore, instead of constructing a non-magnetic strip and attaching magnets thereto, one may also simply construct the spout (10) having a strip that is itself a magnet, thereby eliminating the need for attaching magnets to a strip. In addition, other means for suspending a paintbrush (40) over the can (24), including hooks and fasteners, may be used as well in connection with the invention.

Figure 9:
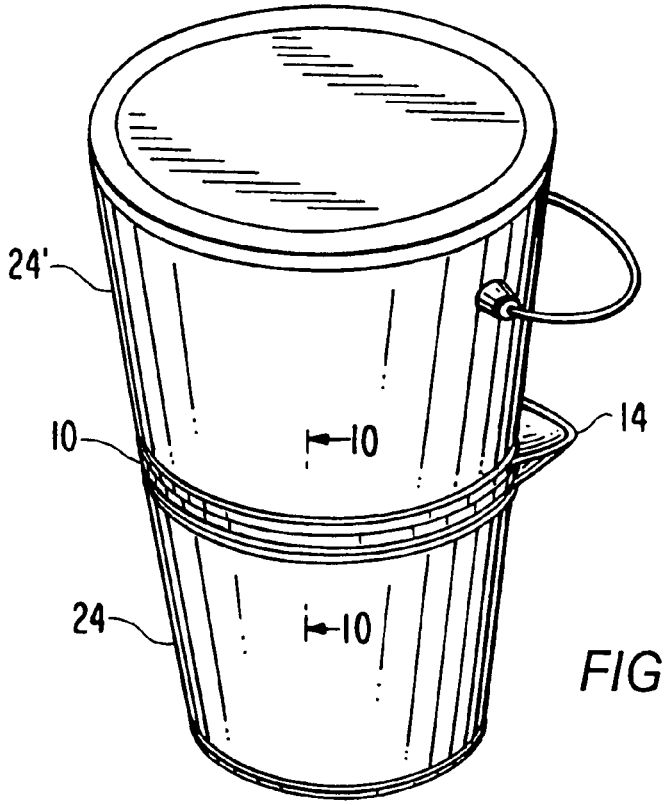
FIG. 9 is a perspective view of two paint cans stacked on top of one another, wherein the top can rests on the pouring spout that is inserted into the bottom paint can.
Figure 10:
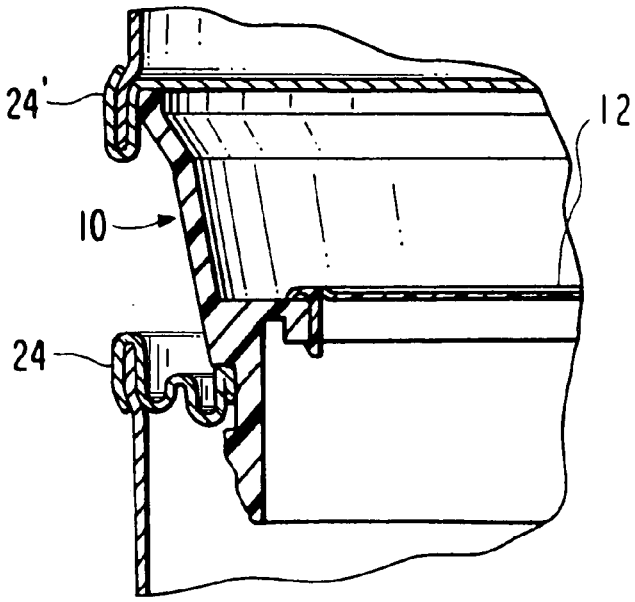
FIG. 10 is partial cross sectional view of the base of one paint can resting on a pouring spout that is inserted in the opening of another paint can taken along line 10—10 of FIG. 9.

FIGS. 9 and 10 depict two paint cans (24, 24') stacked on top of one another, wherein the top can (24') rests on the pouring spout (10) that is inserted into the bottom paint can (24). Thus, a preferred embodiment of the spout (10) possesses an upper rim (20) having a circumference corresponding to that of the typical paint can (24') resting on it, wherein the circumference of upper rim (20) is just slightly smaller than the circular base of the can (24'). This enables the can to rest on the upper rim (20) rather than at some point in the interior of the spout (10).

Figure 11:
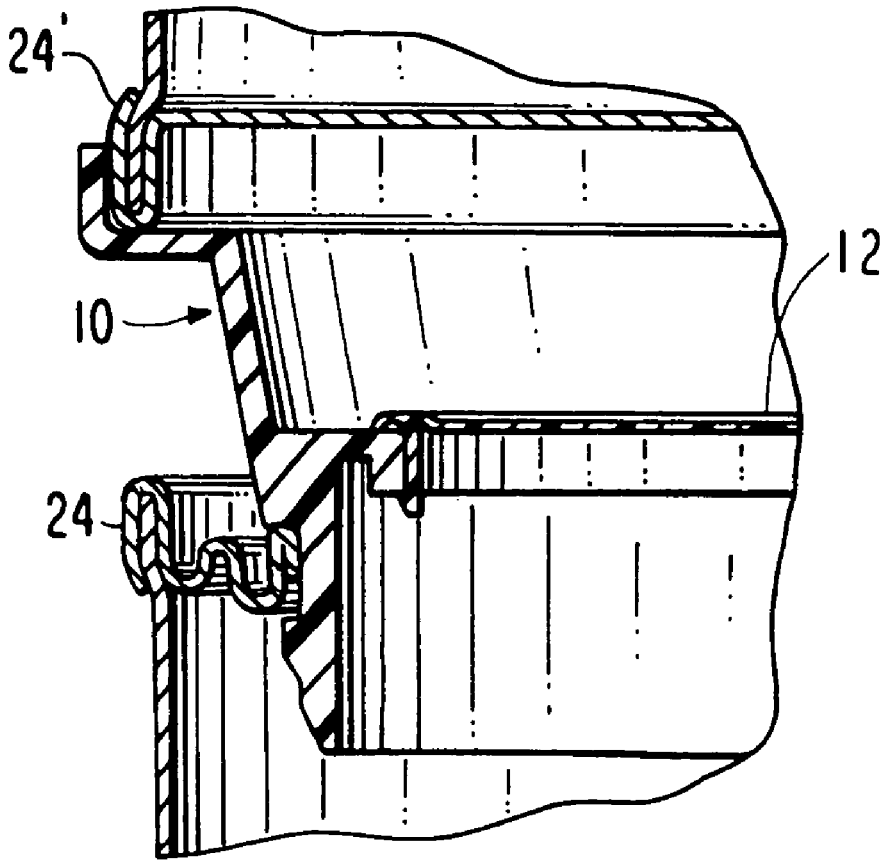
FIG. 11 is partial cross sectional view of the base of one paint can resting on a step off the interior wall of a pouring spout that is inserted in the opening of another paint.

Obviously, the upper rim of the spout (10) may also from a circle that is larger than the base of the paint can (24'). In this embodiment, a step, as shown in FIG. 11, is constructed just off the interior wall (18) of the spout (10), allowing the base of the paint can (24') to rest on the step, rather than the upper rim (20).

It should be noted that the inventive arrangement enables the functions of stacking cans, pouring liquid out of a container, easily removing a lid of a container holding liquid.

Although the invention is described in terms of particular embodiments, it is to be understood that the embodiments are merely illustrative of an application of the principles of the invention. Numerous modifications may be made and other arrangements may be devised without departing from the spirit and scope of the invention.

The invention claimed is:

1. A device used for pouring fluid out of a container when said device is engaged to said container, comprising:

a spout;

a wall having an inner surface and an outer surface, said inner surface and said outer surface of said wall continuing around an interior of said device and said spout extending radially outward from said wall;

a first locking means for engaging said device to said container at an opening of said container;

a removable lid that is selectively attachable and detachable from said wall of said device, said lid covering said opening of said container when said lid is engaged to said device;

a second locking means for engaging said lid to said device;

wherein said fluid flows out of said container via said spout;

wherein said device helps prevent said fluid from accumulating at said opening of said container; and wherein said device is selectively attachable and detachable from said container.

2. The device of claim 1, wherein said first locking means comprises a locking lip located along said outer surface of said wall, said lip capable of engaging a rim of said container.

3. The device of claim 1, wherein said second locking means comprises a locking lip located along a periphery of said removable lid, said lip capable of engaging a complementary edge located at said inner surface of said wall.

4. The device of claim 1, wherein said fluid is paint and said container is standard rigid, cylindrical paint can, wherein said device is adapted to be used with said standard rigid, cylindrical paint can.

5. The device of claim 1, wherein said device further comprises a protruding surface extending inwardly from said wall, said surface primarily used for removing fluid from a brush when said brush is drawn against said protruding surface.

6. The device of claim 5, wherein said protruding surface is substantially flat.

7. The device of claim 5, wherein said protruding surface has a substantially straight edge.

8. The device of claim 5, wherein said protruding surface is sloped.

9. The device of claim 8, wherein said protruding surface slopes downward toward an interior of said container.

10. The device of claim 5, wherein said protruding surface comprises at least one magnet.

11. The device of claim 5, wherein said protruding surface is located opposite said spout.

12. The device of claim 5, wherein said protruding surface is located beneath said lid when said lid is engaged to said device.

13. The device of claim 1, wherein said device further comprises a pulling means from said spout for manually disengaging said device from said container.

14. The device of claim 13, wherein said pulling means is a loop.

15. The device of claim 13, wherein said pulling means is a tab.

16. The device of claim 1, wherein said lid comprises a pulling means for manually disengaging said lid from said device.

17. The device of claim 16, wherein said pulling means is a loop.

18. The device of claim 16, wherein said pulling means is a tab.

19. The device of claim 1, wherein said wall comprises an upper edge, said edge forming a shape that corresponds to an underside of said container such that said underside of said container may rest upon said upper edge of said spout.

20. The device of claim 19, wherein a weight of said container is distributed along said upper edge of said wall.

21. A pour spout for neatly pouring liquids out of a container which also helps prevent liquids from accumulating around an opening of said container comprising:

a mouth, a central opening and a wall that proceeds around an interior area of said spout, said mouth extending radially outward from said wall;

a groove on an exterior surface of said wall for attaching said spout to said container;

a bridging strip;

wherein said mouth is constructed to facilitate the flow of liquid out of said container;

wherein said spout is selectively attachable and detachable from said container and is capable of rotational movement around the opening of said container when attached to said container; and wherein said wall has an upper edge and a lower edge, said lower edge being fitted to the dimensions of said opening of said container.

22. The spout of claim 21, wherein the lower edge of said spout forms a geometric shape.

23. The spout of claim 22, wherein said geometric shape is circle.

24. The spout of claim 21, wherein the lower edge of said spout is circular.

25. The spout of claim 21, wherein said container is a paint can.

26. The spout of claim 21, further comprising a removable lid, said lid being selectively attachable and detachable to said spout at or near said central opening.

27. The spout of claim 26, wherein said lid comprises one or more grooves located on a perimeter of said lid, enabling said lid to snap into place at or near said central opening of said spout.

28. The spout of claim 26, wherein said spout further comprises a receiving means at said central opening to receive said lid forming a seal at said central opening.

29. The spout of claim 21, wherein said strip is located beneath said lid when said lid is attached to said spout.

30. The spout of claim 21, wherein said strip comprises a surface that is inclined.

31. The spout of claim 21, wherein said strip comprises a surface that is flat.

32. The spout of claim 21, wherein said strip has an edge.

33. The spout of claim 32, wherein said edge of said strip is sloped.

34. The spout of claim 21, wherein said strip is located opposite said mouth of said spout.

35. The spout of claim 21, wherein said strip corresponds to a length that approximates the measure between any two points on an interior of said wall of said spout.

36. The spout of claim 21, wherein said strip is of a length that is less than the distance between the two furthest points at said central opening.

37. The spout of claim 21, wherein said strip has one or more magnets located on a surface of said strip such that one or more of said magnets are exposed.

38. The spout of claim 21, wherein said strip is a magnet.

39. The spout of claim 21, wherein said upper edge forms a shape that corresponds to an underside of said container such that said underside of said container may rest evenly upon said upper edge of said spout.

40. The spout of claim 21, wherein said spout further comprises a stepped surface on the interior of said wall wherein the underside of said container may rest evenly upon said step.

41. A pouring apparatus for use in conjunction with pouring paint out of a paint can comprising:

a paint can;

one or more passageways from which paint flows;

an inner cavity having a lateral periphery;

a wall bordering said periphery of said inner cavity;

a strip;

a removable cover;

a first attaching means and a second attaching means wherein said wall forms a contour of one or more of said passageways, wherein at least one of the said passageways extends radially outward from said wall;

wherein said first attaching means is used to selectively attach said cover to said apparatus in a vicinity of said inner cavity; and wherein said second attaching means is used to selectively attach said apparatus to said paint can.

42. The apparatus of claim 41, wherein one or more of said passageways is a gap in said wall.

43. The apparatus of claim 41, wherein one or more of said passageways is attached to said wall.

44. The apparatus of claim 41, wherein said strip comprises one or more exposed magnets.

45. The apparatus of claim 44, wherein said strip comprises two magnets.

46. The apparatus of claim 41, wherein said strip is located beneath said cover when said cover is selectively attached to said apparatus at said inner cavity.

47. The apparatus of claim 41, wherein said paint can is a one gallon paint can.

48. The apparatus of claim 47 wherein said wall has an upper edge shaped to hold and support said can when said can is resting upright on said edge.

49. A spout comprising:

a mouth, a central opening, and a wall that proceeds around an interior area of said spout, said spout extending radially outward from said wall;

a removable lid, said lid being selectively attachable and detachable to said spout at or near said central opening to prevent entry of foreign material into said container when said lid is attached to said spout;

wherein said mouth is constructed to facilitate the flow of liquid out of a container having an opening;

wherein said spout is selectively attachable and detachable from said container;

wherein said wall has an upper edge and a lower edge, said lower edge being fitted to dimensions of said opening of said container such that said spout is detachably secured into place at said opening when said lower edge is inserted into said container; and wherein said upper edge corresponds to a bottom of said container whereby said container can rest upright on said upper edge and a weight of said container is distributed along said upper edge of said spout.

50. The spout of claim 49, further comprising a surface that protrudes inwardly from said wall.

51. The spout of claim 50, wherein said surface is flat.

52. The spout of claim 51, wherein said surface has an edge.

53. The spout of claim 52, wherein said edge is generally straight.

54. The spout of claim 49, wherein said surface comprises one or more magnets.

55. The spout of claim 49, wherein multiple containers can be stacked upon one another with said spout positioned between said containers.

56. The spout of claim 49, wherein said lower edge of said wall comprises a cutout positioned to permit the flow of liquid out of said container.

57. The spout of claim 56, wherein said cutout is vertically aligned with said mouth.

* * * * *